US006585611B2

(12) United States Patent
Vogel

(10) Patent No.: US 6,585,611 B2
(45) Date of Patent: Jul. 1, 2003

(54) ATHLETIC THROWING TECHNIQUE TRAINING APPARATUS AND METHODS

(76) Inventor: Christopher A. Vogel, Box 74, Marshall, WA (US) 99020

( * ) Notice: Subject to any disclaimer, the term of this patent is extended or adjusted under 35 U.S.C. 154(b) by 0 days.

(21) Appl. No.: 09/882,609

(22) Filed: Jun. 15, 2001

(65) Prior Publication Data

US 2002/0058555 A1 May 16, 2002

Related U.S. Application Data

(60) Provisional application No. 60/247,863, filed on Nov. 14, 2000.

(51) Int. Cl.[7] ..... A63B 69/40

(52) U.S. Cl. ..... 473/450; 473/207; 473/212; 473/213; 473/422

(58) Field of Search ..... 473/450, 437, 473/615, 266, 276, 277, 451, 458, 464, 215; 273/440, 355, 349, 356, 348, DIG. 30, 348.4; 2/459, 461, 462, 102; 124/79, 4, 41.1

(56) References Cited

U.S. PATENT DOCUMENTS

| | | | | | |
|---|---|---|---|---|---|
| 475,432 | A | * | 5/1892 | Blades | 2/16 |
| 2,980,426 | A | * | 4/1961 | Johnson | 473/213 |
| 3,479,027 | A | * | 11/1969 | Fryer | 273/459 |
| 3,643,960 | A | * | 2/1972 | Gentilly | 446/193 |
| 3,888,482 | A | | 6/1975 | Starrett et al. | |
| 4,514,862 | A | * | 5/1985 | A'Costa | 2/268 |
| 4,519,608 | A | * | 5/1985 | Gilly | 473/215 |
| 4,605,227 | A | * | 8/1986 | Hurd et al. | 403/104 |
| 4,875,677 | A | * | 10/1989 | Tetreault | 473/458 |
| 4,971,334 | A | * | 11/1990 | Stewart | 273/348.4 |
| 4,984,789 | A | * | 1/1991 | Socci | 473/458 |
| 4,986,548 | A | * | 1/1991 | Conner | 273/348.4 |
| 5,221,092 | A | * | 6/1993 | Simons et al. | 124/1 |
| 5,348,292 | A | * | 9/1994 | Norman, Sr. | 473/213 |
| 5,403,002 | A | | 4/1995 | Brunty | |
| 5,451,060 | A | * | 9/1995 | Dalbo | 2/115 |
| 5,658,203 | A | * | 8/1997 | Shub | 473/205 |
| 5,713,804 | A | * | 2/1998 | Socci et al. | 473/211 |
| 5,785,603 | A | * | 7/1998 | Lazier | 273/DIG. 30 |
| 5,951,408 | A | * | 9/1999 | Inman | 273/DIG. 30 |
| 6,375,581 | B1 | * | 4/2002 | Urban et al. | 473/207 |

* cited by examiner

*Primary Examiner*—Paul T. Sewell
*Assistant Examiner*—Nini F. Legesse
(74) *Attorney, Agent, or Firm*—Reidlaw, L.L.C.; John S. Reid; Thomas A. Olson

(57) ABSTRACT

Methods and apparatus for training a trainee to achieve or maintain proper throwing technique by attaining proper form, position, and movement of the legs, hips, torso, and shoulders of the trainee and without the use of the throwing arm of the trainee. An apparatus in accordance with the present invention includes a harness to be worn about the torso of the trainee, wherein the harness is configured to releasably support thereon a training projectile which is configured to be launched from is supported position on the harness as a result of a training maneuver which does not involve the throwing arm of trainee. A method in accordance with the present invention includes providing a training projectile, releasably supporting the projectile proximate a throwing shoulder of the trainee, executing a training maneuver and launching the projectile as a result of the execution of the training maneuver.

22 Claims, 6 Drawing Sheets

ATHLETIC THROWING TECHNIQUE TRAINING APPARATUS AND METHODS

RELATED CASES

This application claims priority to U.S. Provisional Patent Application No. 60/247,863 filed Nov. 14, 2000.

FIELD OF THE INVENTION

This invention pertains to athletic training apparatus and methods, and more specifically, to athletic training apparatus and methods for improving or maintaining throwing technique.

BACKGROUND OF THE INVENTION

Athletes often employ various training apparatus and methods to improve athletic performance. Such training apparatus and methods can be divided into at least two groups. One such group includes training apparatus and methods which are primarily aimed at improving or maintaining the physical conditioning the athlete. That is, such athletic conditioning training apparatus and methods are generally configured to improve or maintain the strength and stamina of the athlete. An example of a conditioning training apparatus is a set of weights for weightlifting. Similarly, an example of a conditioning training method is a method of using such weights to increase strength and stamina of an athlete.

The other of the two groups of athletic training apparatus and methods includes apparatus and methods which are aimed primarily at improving or maintaining an athletic technique. When I say "technique" I mean the manner in which an athlete executes an athletic maneuver such as running, jumping, throwing, and the like. That is, such athletic technique training apparatus and methods are generally configured to improve or maintain an athlete's form, body positioning, and movement while performing an athletic maneuver.

The technique possessed by an athlete can be as important, if not more important, than the strength and/or stamina of the athlete. That is, assuming all other factors are equal, an athlete of inferior conditioning and stamina who possesses superior technique can sometimes out-perform an athlete of superior conditioning and stamina who possesses inferior technique. Superior athletic technique, then, can be a determining factor in the outcome of any given athletic event such as a game or other competition.

One type of athletic maneuver in which technique can be important is that of throwing an athletic projectile. When I say "athletic projectile" I mean an object that is thrown by an athlete in furtherance of an athletic event. When I say "thrown" I mean propelled so as to be airborne by release from the athlete's hand during movement of the athlete's arm. Athletic projectiles can include such things as balls, javelins, hammers, shot puts, discuses, and the like.

Various prior art training apparatus and methods have been developed to be used for training athletes in proper throwing technique. Typically, such prior art throwing technique training apparatus involve devices that are configured to be attached to, or supported on, the athlete's throwing arm or throwing hand. When I say "throwing arm" I mean the athlete's arm which is typically used by the athlete for throwing an athletic projectile. Similarly, when I say "throwing hand" I mean the athlete's hand that is on the throwing arm. Typical prior art throwing training methods likewise involve methods of training the form, movement, and position, of the athlete's throwing arm and/or throwing hand.

In many cases, proper athletic throwing technique depends not only on proper form, movement, and position of the athlete's throwing hand and throwing arm, but also on the proper form, movement, and position of the remainder of the athlete's body as well. That is, in many cases, proper athletic throwing technique requires proper form, movement and position of the athlete's legs, hips, torso, and shoulders as well as the athlete's arms and hands. However, because typical prior art athletic throwing training apparatus and methods primarily concentrate only on the form, movement, and position of the athlete's throwing arm and throwing hand, such prior art apparatus and methods lack the capability to facilitate complete training of the remainder of the athlete's body for athletic throwing.

An example of a prior art athletic throwing technique training apparatus is the Baseball Pitcher's Training Device which is disclosed in U.S. Pat. No. 3,888,482 to Starrett et al. The training device disclosed by Starrett comprises a wrist band, a pair of loops which are adapted to encircle the base of two spaced fingers, and an elastically stretchable connecting strap which interconnects the wrist band and each of the pair of loops.

The training device of Starrett serves to train an athlete to flex the throwing wrist so as to impart maximum speed and rotation to a ball thrown by the athlete. Thus, the Starrett patent discloses a training apparatus which is to be worn on the throwing hand of the athlete and which is primarily aimed at training the athlete to achieve the proper form, movement, and position of the athlete's throwing hand and wrist.

Another example of a prior art athletic throwing technique training apparatus is the Throwing Arm Training Device which is disclosed by U.S. Pat. No. 5,403,002 to Brunty. The training device disclosed by Brunty comprises an upper arm and a forearm cuff having bars extending there from pivotally connected in the vicinity of the elbow by pivot screws mounted on a plate and connected to a limit plate having two arcuate slots centered on the pivot screws.

The training device of Brunty is configured to by attached to an athlete's throwing arm to limit the flexion angle of the throwing arm to a maximum angle of 90 degrees or more and also the angle of extension to a desired minimum angle, thereby encouraging maximum use of the latisimus dorsi muscle while discouraging sidearm throwing. Thus, the Brunty patent discloses a training apparatus which is configured to be worn on the throwing arm of the athlete and which is primarily aimed at training an athlete to achieve the proper form, movement, and position of the athlete's throwing arm.

As is evident from the discussion of the two patents discussed above, typical prior art throwing training apparatus facilitate training for proper form, movement, and position of only the athlete's throwing arm, wrist, and hand. That is, typical prior art throwing training apparatus do no address training of the remainder of the athlete's body, such as the legs, hips, torso, and shoulders. As mentioned above, proper throwing technique requires proper form, movement, and position of the athlete's entire body, and not just the throwing arm, wrist, and hand. Thus, the prior art throwing training apparatus and methods cannot be relied upon to provide thorough throwing training for athletes.

What is needed then, are throwing training apparatus and methods which achieve the benefits to be derived from similar prior art devices, but which avoid the shortcomings and detriments individually associated therewith.

SUMMARY OF THE INVENTION

The invention includes methods and apparatus for training a trainee in achieving or maintaining efficient and effective form, movement, and position of the trainee's legs, hips, torso, and shoulders during a throwing maneuver. Thus, the various embodiments of the present invention include apparatus and methods that employ the use of a training projectile which is to be releasably supported on the trainee, or on an apparatus supported by the trainee, and preferably proximate the throwing shoulder of the trainee, and then launched therefrom as a result of the execution of training maneuver by the trainee, wherein the training maneuver does not employ use of the throwing arm of the trainee. Moreover, in preferred embodiments of the apparatus and methods in accordance with the present invention, the throwing arm of the trainee is restrained so to be substantially immobilized during execution of the training maneuver.

In accordance with a first embodiment of the present invention, an apparatus comprises a harness which is configured to be supported, or worn, substantially about the torso of a trainee, and which is further configured to releasably support a training projectile thereon. The apparatus can also be configured to releasably support the training projectile substantially proximate the throwing shoulder of the trainee.

In accordance with a second embodiment of the present invention, a method of training a trainee includes providing a training projectile and releasably supporting the training projectile proximate the throwing shoulder of the trainee. The method further includes executing a training maneuver and launching the training projectile from its supported position as a result of performing the training maneuver.

DETAILED DESCRIPTION OF THE INVENTION

The invention includes methods and apparatus for training a trainee for achieving and/or maintaining proper throwing technique by facilitating proper form, position, and movement of the legs, hips, torso, and shoulders of the trainee without substantial use of the trainee's throwing arm. That is, the apparatus and methods of the instant invention are intended to facilitate the learning of proper throwing technique primarily of the legs, hips, torso, and shoulders.

Figure 1:
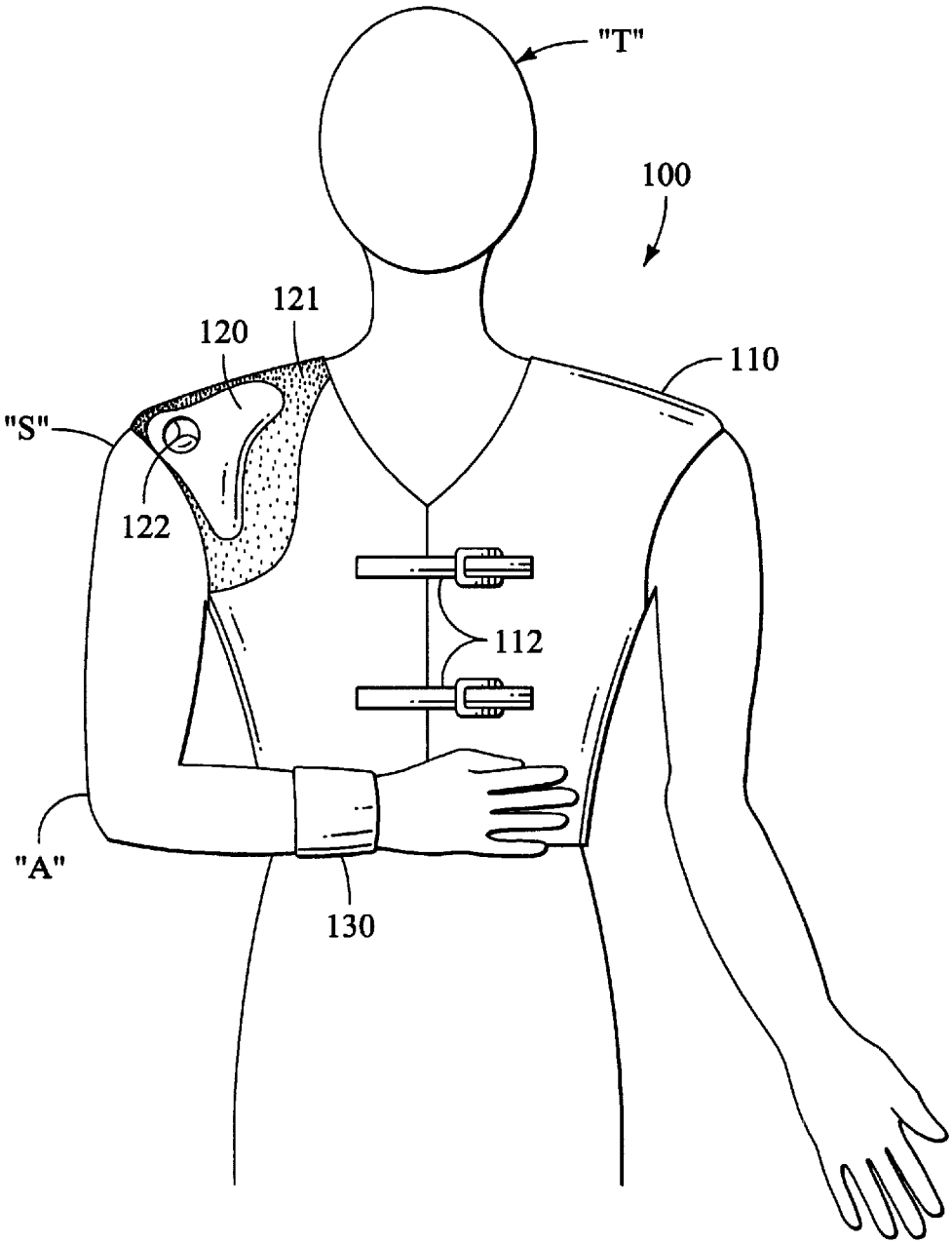
FIG. 1 depicts a front view of an apparatus in accordance with a first embodiment of the present invention.

Beginning with FIG. 1, a front view is shown of an athletic training apparatus 100 in accordance with a first embodiment of the present invention. The athletic training apparatus 100 is configured to be used for training a trainee "T" to achieve proper throwing technique of the legs, hips, torso, and shoulders. That is, the purpose of the athletic training apparatus 100 is to facilitate training a trainee "T" in proper throwing technique generally without use of the arms or hands of the trainee in such training. This is achieved by concentrating on developing the correct motor patterns of the lower body.

The athletic training apparatus 100 comprises a harness 110 which is configured to be supported, or worn, substantially about the torso of the trainee "T" as shown. When I say "torso" I mean to include portions of the body of the trainee other than those of the limbs and head. That is, although the harness 110 can also be partially supported by one or more limbs of the trainee "T," and/or the head of the trainee, the harness is primarily supported by the torso. The harness 110 can be configured generally as a vest, or the like, as shown. When configured as a vest, the harness is preferably fabricated from a material such as woven nylon or cloth fabric or the like. The harness 110 can be equipped with fastening devices 112, or the like, which are configured to adjustably fasten the harness 110 about the torso of the trainee "T."

The fastening devices 112 can comprise, for example, straps and buckles, or the like, to provide adjustable fastening of the harness 110 about the torso of the trainee "T." Preferably, the harness 110 fits the trainee "T" in a substantially snug manner so that movement of the harness relative to the torso of the trainee "T" is prevented. That is, preferably, the harness 110 is configured to fit the trainee "T" in a way which causes the harness to remain substantially in the same location on the trainee during athletic maneuvers and the like thereof.

It is understood that the harness 110 need not be configured exactly as shown and can be alternatively configured in any of a number of manners. For example, the harness 110 can be configured to comprise a plurality of interconnecting webs, straps, or the like, which are to be fastened about the torso of the trainee "T." That is, it is understood that the harness 110 can be configured in any manner which serves the purpose for which the harness is intended, which will become more apparent in later discussion.

The athletic training apparatus 100 can further comprise a support unit 120 which is attached to the harness 110. Preferably, the support unit 120 is attached to the harness 110 substantially proximate the throwing shoulder "S" of the trainee "T" when the harness is being worn by the trainee. When I say "throwing shoulder" I mean the shoulder of the trainee "T" to which the arm normally used by the trainee for throwing an athletic object such as a ball, a javelin, or the like, is attached.

Preferably, the support unit 120 is fabricated from a relatively light-weight, yet rigid, material such as, injection-molded plastic or the like. More preferably, the support unit 120 is shaped so as to facilitate substantially stable positioning thereof against the harness 110. For example, preferably, the support unit 120 is shaped to substantially conform to the profile of the body of the trainee "T." The proportions of the support unit 120 which contact the harness 110 are preferably broad and flat to facilitate positional stability of the support unit relative to the harness 110.

The support unit 120 is preferably adjustably attached to the harness 110. When I say "adjustably attached" I mean attached so that the position of the support unit 120 relative to the harness 110 can be adjusted, or changed. Preferably, the training apparatus 100 can include an adjustment device 121. The adjustment device 121 can comprise, for example, a patch comprising a plurality of Velcro® loops, or the like, which is attached to an area of the harness 110 surrounding the location of the throwing shoulder of the trainee "T" when the trainee is wearing the harness. (Velcro® is a registered trademark of Velcro Industries B.V.)

In addition, for example, the adjustment device 121 can comprise at least one patch comprising a plurality of Velcro® hooks (not shown), or the like, which is attached to the support unit 120 so that the support unit can be adjustably positioned relative to the harness 110 by way of the fastening action of the Velcro® hooks and loops. In this manner, the support unit 120 can be adjustably repositioned, or moved, on the harness 110 as required by way of the adjustment device 121. That is, the position of the support unit 120 can be changed, or adjusted, by manipulating the adjustment device 121 to achieve proper positioning of the support unit 120 relative to the harness 110.

For example, in the case wherein the adjustment device 121 comprises a plurality of Velcro® hooks and loops, the support unit 120 can be repositioned on the harness 110 by pulling the support unit from the harness 110 so as to disengage the Velcro® hooks and loops from one another. The support unit 120 can then be repositioned on the harness 110 by pushing the support unit against the harness so as to re-engage the Velcro® hooks and loops. It is understood that the adjustment device 121 can comprise any means of providing adjustment of the position of the support unit 120 relative to the harness 110. For example, an alternative configuration (not shown) of the adjustment device 121 comprises a plurality of adjustable straps connecting the support unit to the harness.

As further seen, the support unit 120 preferably defines an opening 122 therein. The opening 122 is preferably configured to releasably support a training projectile (not shown), which will be discussed, along with the opening 122, in greater detail below. The function and purpose of the support unit 120, the opening 122, as well as the training projectile will be become apparent in later discussion. The opening 122 passes at least partially into the support unit 120 so as to form a cavity therein.

Alternatively, however, the opening 122 passes completely through the support unit 120. That is, the opening 122 can alternatively be in the form of an annular passage which passes completely through the support unit 120. Preferably, the opening 122 has a substantially constant cross-sectional shape and dimension. For example, the opening 122 is preferably cylindrical in form, and preferably has a substantially circular cross-section. However, it is understood that the cross-section of the opening 122 can be any shape, such as square, rectangular, or elliptical, for example.

The training apparatus 100 preferably comprises a restraint device 130 which is configured to substantially restrain the throwing arm "A" of the trainee "T" during performance of training maneuvers by the trainee. The use of such a restraint device 130 for restraining movement of the throwing arm "A" can promote beneficial use of the apparatus 100, as will become more apparent in later discussion. When I say "restrain" I mean to either passively or actively limit the movement of the throwing arm "A." When I say "throwing arm" I mean the arm of the trainee "T" which is used thereby to normally throw an object such as an athletic projectile or the like. In other words, the intended purpose of the restraint device 130 is to at least temporarily facilitate the partial or substantial immobilization of the throwing arm of the trainee "T" during performance of training maneuvers.

The restraint device 130 can be configured in any of a number of possible manners which achieve the general purpose of restraining movement of the throwing arm "A" during execution of training maneuvers by the trainee "T." For example, the restraint device 130 can comprise a fabric, plastic, or metal cuff or the like which is configured to be fastened around the wrist and/or forearm of the throwing arm "A" of the trainee "T," and wherein the cuff is configured to be attached to the harness 110 to limit the movement of the throwing arm. Such a configuration of the restraint device 130 can be considered an active manner of restraining the throwing arm "A" wherein the throwing arm can neither be voluntarily nor involuntarily removed from the restraint device without first unfastening the restraining device from the throwing arm.

An alternative configuration of the restraint device 130 can be to provide a handle or the like which is attached to the harness 110, and which is configured to be grasped by the hand of the throwing arm "A" during execution of a training maneuver by the trainee "T." As a further alternative configuration, the restraint device 130 can comprise a pouch, pocket, or "holster," or the like, in which the hand of the throwing arm "A" can be placed during the performance of a training maneuver.

These latter two examples of alternative configurations of the restraint device 130 can be considered passive manners of restraining the throwing arm "A" because, in each case, the throwing arm can be removed from the restraint device 130 involuntarily and without any further manipulation, or the like, of the restraint device. Thus, use of passive forms of the restraint device 130 can require greater concentration on the part of the trainee "T" in order to voluntarily maintain a restrained position of the throwing arm "A" during the performance of athletic training maneuvers.

Figure 2:
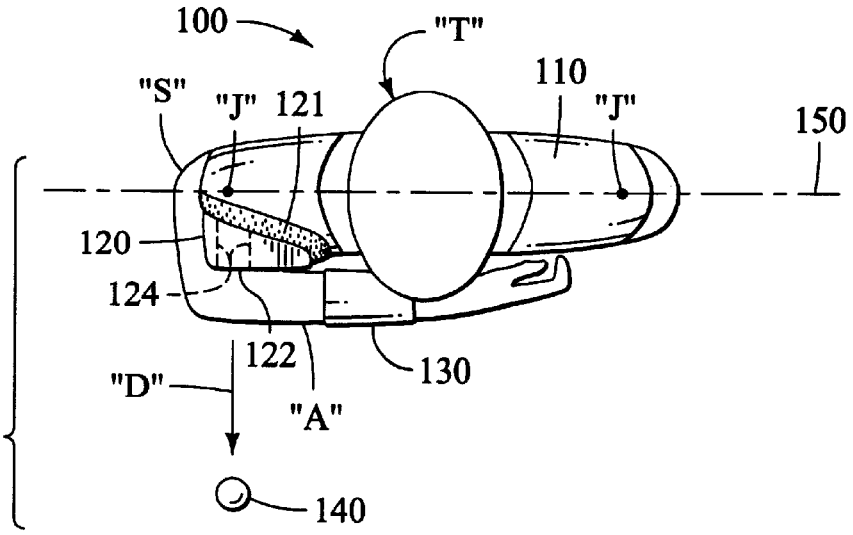
FIG. 2 is a top view of the apparatus which is depicted in FIG. 1.

Moving now to FIG. 2, a top view is shown of the athletic training apparatus 100 which is depicted in FIG. 1. As is seen, the training apparatus 100 can comprise a training projectile 140. When I say "training projectile" I mean an object which is configured to be releasably supported on the harness 110 and which is further configured to be launched there from by movement of the trainee "T" during execution of a training maneuver. The training projectile 140 can have any of a number of different shapes, including that of a sphere as shown. The training projectile 140 can also have alternative shapes, such as that of a cylinder, or the like.

Figure 7:
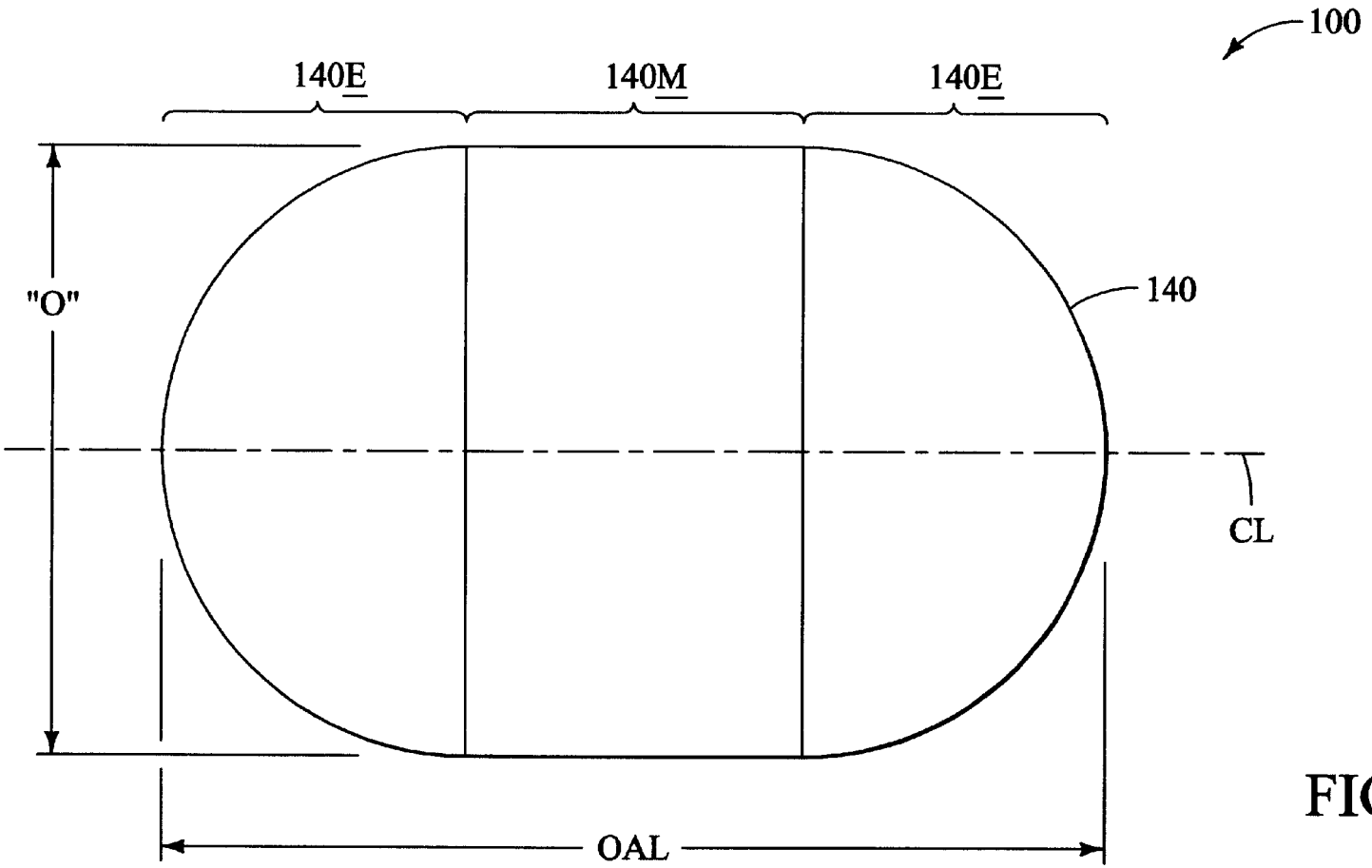
FIG. 7 is a side view of an alternative configuration of a training projectile.

Moving to FIG. 7, a side view is shown which depicts a training projectile 140 of the apparatus 100. The training projectile 140 which is depicted in FIG. 7 is shown with a preferred shape. That is, preferably, the training projectile 140 comprises a substantially cylindrical center portion 140M which is located between two substantially rounded end portions 140E. Each of the center portion 140M and the end portions 140E are substantially symmetrically formed about a common centerline CL.

The training projectile 140 has a diameter "O" which is measured substantially normally with respect to the centerline CL. The training projectile 140 also has an overall length OAL which is substantially coextensive with respect to the centerline CL. As is evident, the overall length OAL is greater than the diameter "D." Preferably, the overall length is between about five percent and about fifty percent greater than the diameter "D." More preferably, the overall length OAL is between about twenty percent and about thirty percent greater than the diameter "D." Most preferably, the overall length OAL is about twenty-five percent greater than the diameter "D."

Preferably, the center portion 140M as well as the end portions 140E have cross-sectional profiles which are substantially circular, wherein the cross-sectional profiles are substantially normal to the centerline CL. More preferably, the end portions 140E are substantially hemispherical. It is understood that the center portion 140M and the end portions 140E are described separately only for the purpose of describing the shapes thereof. That is, the separate description of the center portion 140M and the end portions 140E is not intended to imply that the center portion and end portions must be separate components or pieces.

The training projectile 140 can be formed, or fabricated, in any of a number of manners, including those wherein the center portion 140M and end portions 140E are made as a single, integral component. Conversely, the center portion 140M and the end portions 140E can each be made as separate components which are attached together. Additionally, the training projectile 140 preferably has both a relatively high density and a smooth, durable exterior. For example, the training projectile 140 can be fabricated from stainless steel, or the like, with a polished exterior surface. Alternatively, the training projectile 140 can be fabricated from carbon steel, or iron, with an exterior plastic coating.

As is evident, the training projectile 140 is preferably used in conjunction with a support unit (shown in FIG. 1) which has a substantially cylindrical opening 122 (also shown in FIG. 1) having an inside diameter that is slightly greater than the diameter "O" of the training projectile. Preferably, the clearance between the diameter "O" of the training projectile 140 is between about one millimeter and about two millimeters. The training projectile 140 can be placed into an opening 122, wherein one of the end portions 140E is first inserted into the opening and wherein the center portion 140M is substantially concentric with the walls 124 (shown in FIGS. 2 and 3) of the opening.

As is evident, the harness 110 is configured to releasably support the training projectile 140 thereon. When I say "releasably support" I mean to support the training projectile 140 in a manner which allows the training projectile to be released and launched away from the harness 110 as a result of execution of an appropriate training maneuver in which the throwing shoulder "S" is generally thrust in a forward direction to impart momentum to the training projectile. Preferably, the harness 110 is configured to releasably support the training projectile 140 in a position which is substantially proximate the throwing shoulder "S."

As is seen, the trainee "T" typically has a pair of arm/shoulder joints "J," each of which form a movable connection between each of the arms and respective shoulders of the trainee. A line of reference 150 can be defined to intersect both of the arm/shoulder joints "J" of the trainee "T" as shown. As is also seen, the support unit 120 preferably has an interior wall, or walls, 124 which define the opening 122. More preferably, the support unit 120 is positionable relative to the harness 110 so that the interior walls 124 are substantially aligned with the throwing arm/shoulder joint "J" as shown. When I say "throwing arm/shoulder joint" I mean the arm/shoulder joint "J" which is proximate the throwing shoulder "S" of the trainee "T."

Even more preferably, the support unit 120 is configured to be positionable relative to the harness 110 so that the interior walls 124 are substantially normal to the line of reference 150 when viewed from above as in FIG. 2. In this manner, the training projectile 140 is releasably supported on the harness 110 so that the training projectile is released there from in a substantially forward direction "D" which is preferably normal to the line of reference 150 when the apparatus 100 is viewed from above, as shown.

Figure 3:
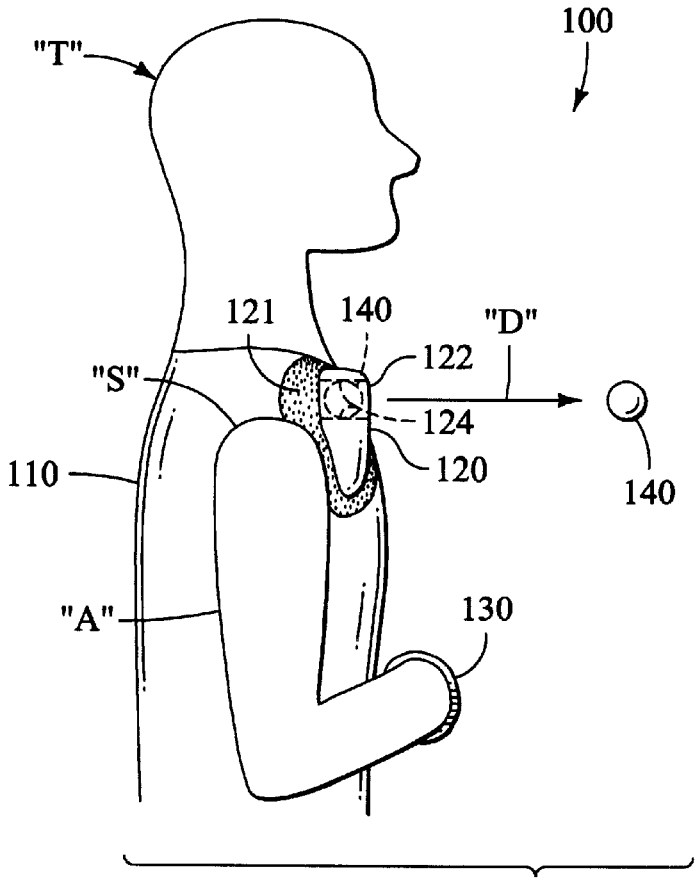
FIG. 3 is side view of the apparatus which is depicted in FIGS. 1 and 2.

Moving now to FIG. 3, a side view is shown of the training apparatus 100 which is depicted in FIGS. 1 and 2. As is evident from the above discussion, as well as a study of the accompanying FIGS. 1, 2, and 3, the training apparatus 100 comprises a harness 110 which is configured to be worn by the trainee "T" about the torso thereof. The harness 110 is configured to releasably support the training projectile 140 thereon so that the training projectile can be launched in the direction "D" as a result of movement of the trainee "T" during execution thereby of a training maneuver. Preferably, the harness 110 is configured to releasably support the training projectile 140 thereon and proximate the throwing shoulder "S" of the trainee "T." The apparatus 100 preferably comprises a restraining device 130 which is configured to either passively, or actively, restrain the movement of the throwing arm "A" of the trainee "T" during execution of the training maneuver.

Figure 4:
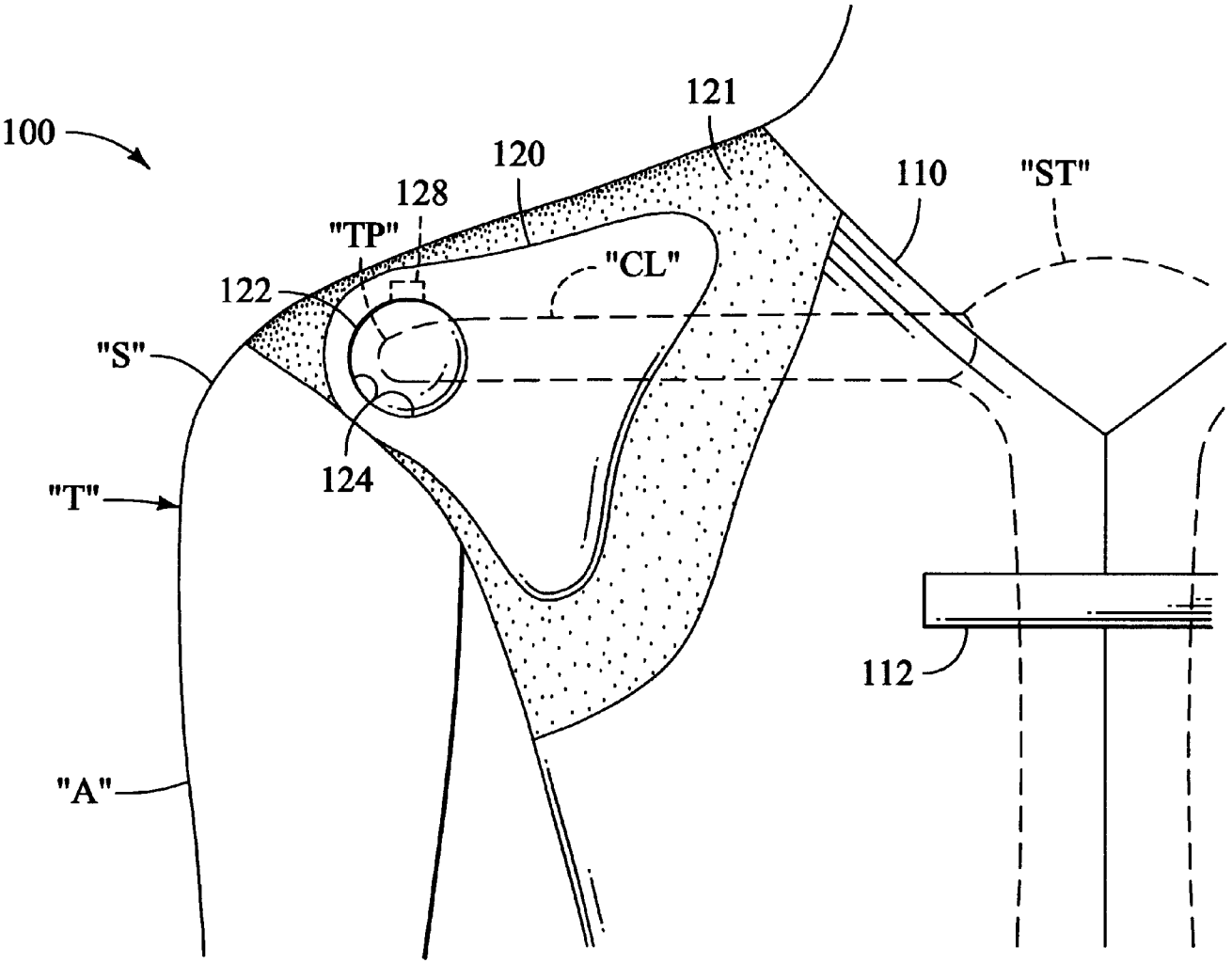
FIG. 4 is a partial front detail view which depicts additional features which can be included in the apparatus which is depicted in FIGS. 1, 2, and 3.

Moving now to FIG. 4, a partial front detail view is shown of the apparatus 100. The partial front view shown in FIG. 4 is intended to illustrate a preferred positioning method of the support unit 120 relative to the throwing shoulder "S" of the trainee "T," as well as additional features which can be included in the apparatus 100. As is shown, a typical human body is equipped with a sternum "ST" which is sometimes referred to as the "breast bone." The typical human body is also typically equipped with a pair of clavicles which are sometimes referred to as "collar bones," and which extend outwardly from the upper end of the sternum "ST" toward the respective shoulders on each side.

As is evident, one such clavicle, which shall be referred to herein as a throwing-side clavicle "CL," is depicted in FIG. 4. When I say "throwing-side clavicle" I mean the clavicle that is located proximate the throwing shoulder "S." The throwing-side clavicle "CL" terminates proximate the throwing shoulder "S" at an outer tip "TP." As is shown, the support unit 120 is preferably positionable relative to the harness 110 such that the opening 122 substantially circumscribes the outer tip "TP" of the throwing-side clavicle "CL." That is, the apparatus 100 is preferably configured so that the opening 122 can be positioned so as to substantially encircle, or align with, the clavicle tip "TP" as shown.

The clavicle tip "TP" can typically be located by touch. Thus, in the case wherein the opening 122 passes completely through the support unit 120, as described above, the opening can be manually repositioned relative to the harness so that the clavicle tip "TP" is substantially encircled by the opening 122. That is, the opening 122 can be placed in the preferred location relative to the clavicle tip "TP" by inserting one or more fingers into the opening and locating the clavicle tip by touch through the fabric, or the like, of the harness 110. Positioning of the opening 122 in this manner relative to the clavicle tip "TP" can promote beneficial use of the apparatus 100 for training purposes in that the maximum velocity of the joint "J" (FIG. 2) of the throwing shoulder "S" can be attained at the location as described above during proper execution of a training maneuver.

Figure 5:
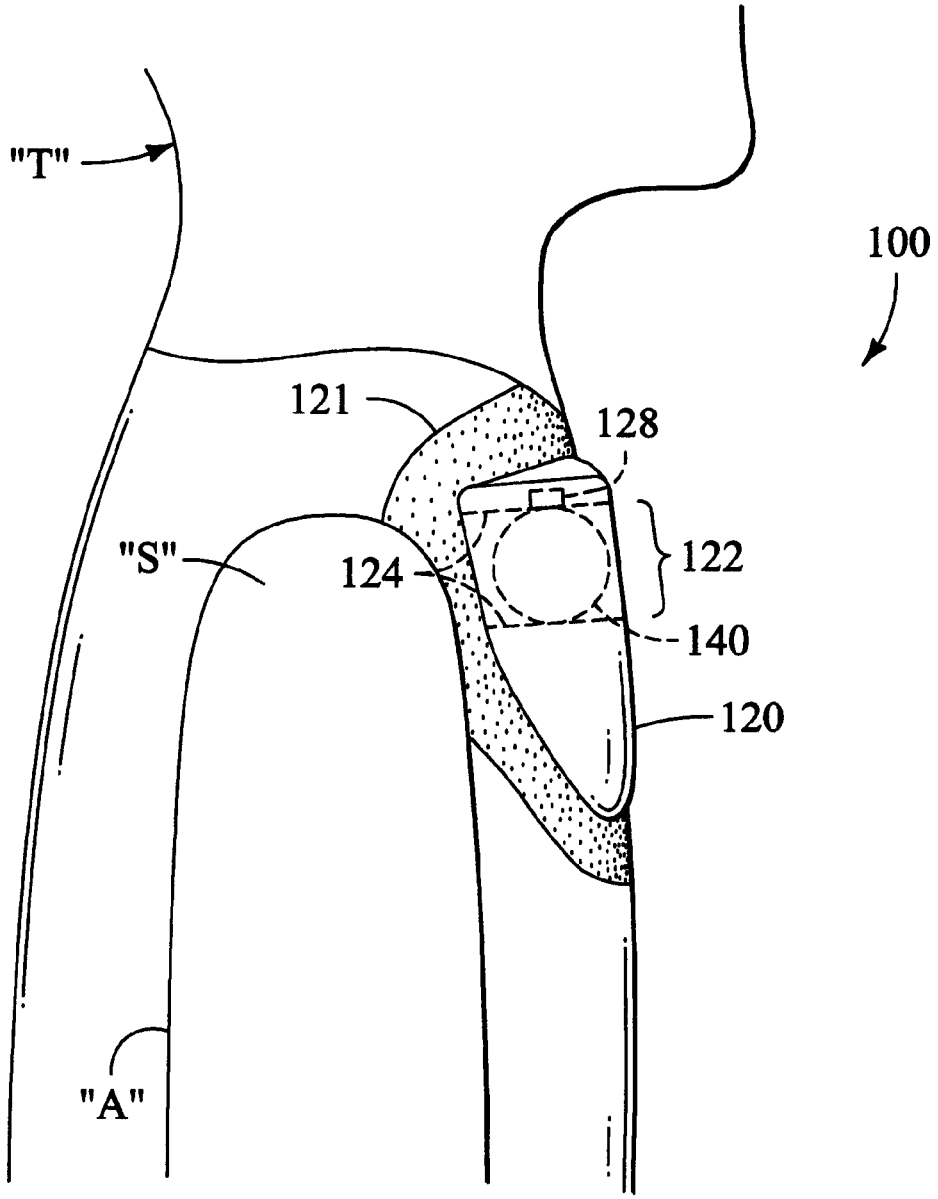
FIG. 5 is a partial side detail view of the apparatus which is depicted in FIG. 4.

As further seen in FIG. 4, the apparatus 100 can comprise a retention device 128. Preferably, the retention device 128 is mounted within the support unit 120 and substantially proximate the opening 122 as shown. However, it is understood that the retention device 128 can be located at other alternative positions. Moving now to FIG. 5, a partial side view is shown of the apparatus 100 which is depicted in FIG. 4. As is seen in FIG. 5, the training projectile 140 is releasably supported on the harness 110, and within the opening 122 which is defined in the support unit 120.

As is further seen, the support unit 120 is mounted on the harness 110 preferably by way of the adjustment device 121. The retention device 128 can also be seen mounted within the support unit 120 and substantially adjacent to the training projectile 140. The retention device 128 is configured to retain the training projectile 140 within the opening 122 of the support unit 120 during normal, non-maneuver movement of the trainee "T."

That is, the retention device 128 is configured to exert a relatively small retention force on the training projectile 140 when the training projectile is releasably supported within the support unit 120, wherein the retention force is sufficient to prevent inadvertent release of the training projectile 140 from its releasably supported position during normal movement of the trainee "T," and during movements leading up to the release of the training projectile during execution of a training maneuver.

Various known configurations of the retention device 128 can be employed. For example, the retention device 128 can comprise a spring-loaded detent roller (not shown) or the like to provide a retention force against the training projectile 140. As another alternative configuration, the retention device 128 can comprise a magnet mounted within the support unit 120. In accordance with this configuration, the training projectile 140 is fabricated from a material comprising iron so that the training projectile is subjected to a magnetic force provided by the magnet of the retention device 128.

Alternatively, the training projectile 140 can be releasably held within the opening 122 by providing for a slight interference fit between the walls 124 of the opening and the training projectile such that the forward motion of the trainee achieved during execution of an appropriate training maneuver causes the training projectile to become dislodged from the interference fit.

Preferably, the walls 124 which define the opening 122 are substantially precisely spaced apart, and the training projectile 140 is dimensioned in a substantially precise manner. That is, preferably, the clearance between the training projectile 140 and the walls 124 is a substantially precise dimension so as to provide a close-tolerance fit of the training projectile within the opening 122. For example, if the diameter of the training projectile 140 is two-and-one-half inches, then the total clearance between the training projectile and the walls 124 can be maintained at between one sixteenth of an inch and one thirty-second of an inch to provide a close-tolerance fit of the training projectile within the opening 122.

Providing such as close-tolerance fit of the training projectile 140 within the opening 122 can be advantageous in facilitating controlled retention of the training projectile within, and accurate release of the training projectile from, its supported position on the harness 110 during execution of a training maneuver. Along with such a close-tolerance fit of the training projectile 140 within the opening 120, sufficient airflow is preferably provided for to avoid creating a suction effect behind the training projectile when attempting to rapidly release the projectile from the opening.

Figure 6:
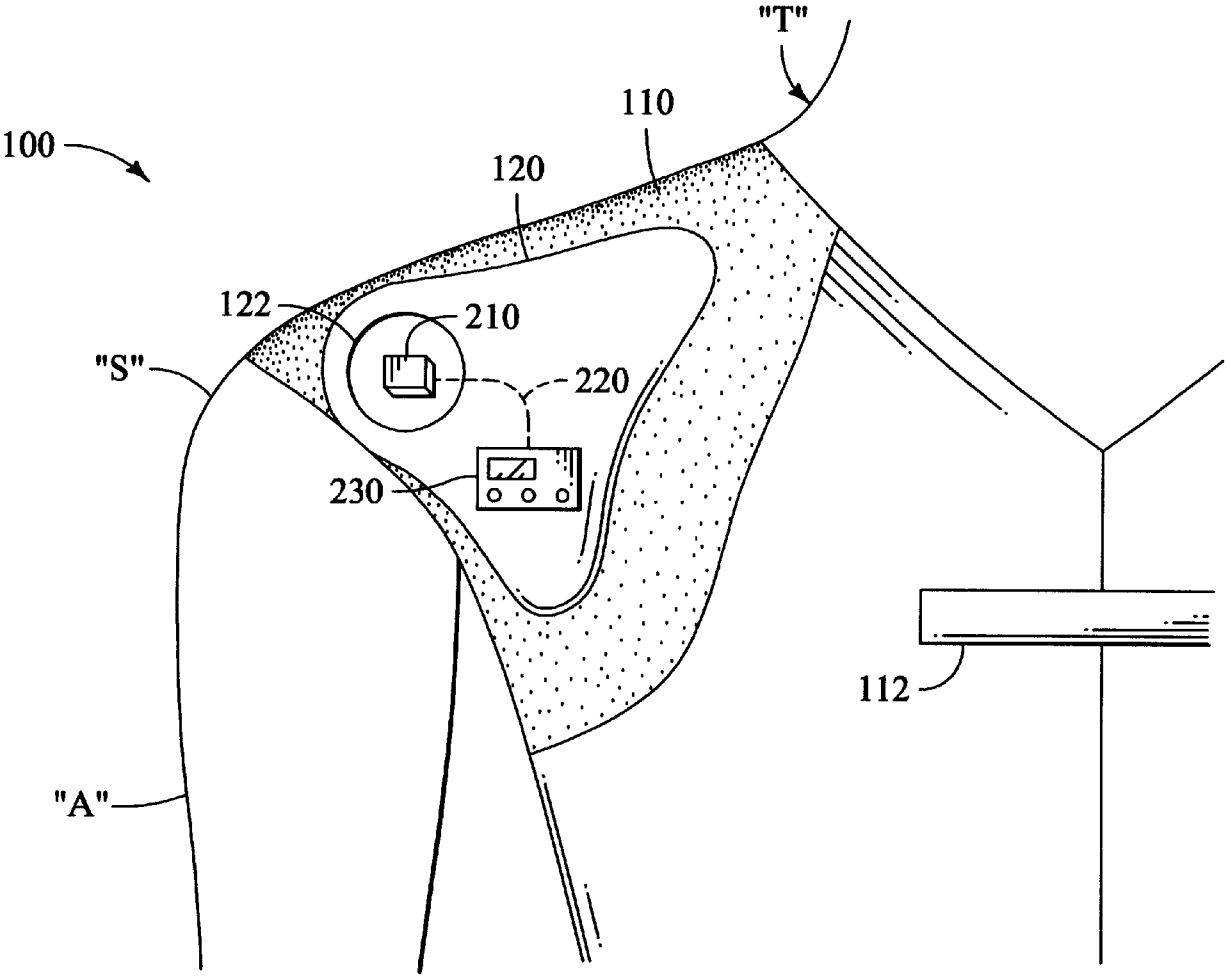
FIG. 6 is another partial front detail view which depicts yet additional features which can be included in the apparatus which is depicted in FIGS. 1, 2, and 3.

Moving now to FIG. 6, another partial front detail view which depicts additional features which can be included in the apparatus 100 which is shown in FIGS. 1, 2, and 3. As is seen, the apparatus 100 can comprise a sensor 210 which is supported on the harness 110. The sensor 210 is configured to detect acceleration forces exerted on the training projectile 140 (shown in FIGS. 2, 3, 5, and 7) during execution of a training maneuver by the trainee "T." Detection and measurement of such acceleration forces exerted on the training projectile 140, which are due to the movement of the trainee "T" during execution of a training maneuver, can be useful in determining the extent to which the trainee is properly executing the training maneuver.

Preferably, the sensor 210 is mounted in a position which is substantially behind, and in contact with, the training projectile 140 when the training projectile is in its releasably supported position on the harness 110. When I say "behind" I mean a side of the training projectile 140 which is substantially opposite the direction of travel "D" of the projectile when the projectile is released and launched during execution of a training maneuver. As the training projectile 140 is accelerated to be launched, the projectile presses against the sensor 210 which can detect the level of force with which the projectile presses against the sensor.

Preferably, the sensor 210 is mounted within the opening 122 of the support unit 120 as shown. Also, the sensor 210 is preferably a load cell. Load cells are known in the art, as are the configuration and operation thereof. The apparatus 100 preferably also comprises a display unit 230 which is connected to the sensor 210 byway of a signal link 220. The signal link 220 is configured to transmit signals and can be, for example, a copper wire, or a strand of fiber optic filament. The display unit 230 can comprise a micro processor or the like as well as a power source such as a battery or the like. The display unit can also comprise a visual display screen such as a liquid crystal display screen.

The display unit 230 is configured to display the acceleration forces detected by the sensor 210. That is, the sensor 210 can detect an acceleration force and can then generate a signal indicative of the magnitude of the force. The signal can then be transmitted to the display device 230 which can receive the signal. The display device 230 can then convert the signal to a visual display character which is then displayed so as to be read by the trainee "T" or the like. Such visual display devices 230 are known in the art.

As mentioned above, the training apparatus 100 can be employed to instruct the trainee "T" in achieving proper form, position, and movement of the legs, hips, torso, and shoulders during execution of a throwing maneuver. That is, proper practice which incorporates the apparatus 100 along with qualified instruction, can facilitate the attainment of efficient throwing technique by achieving proper form, position, and movement of the legs, hips, torso, and shoulders during a throwing maneuver. The degree to which proper technique of the legs, hips, torso, and shoulders of the trainee is exercised and achieved thereby can be gauged by the distance and direction of travel of the training projectile 140 after being launched from its releasably supported position on the harness 110 as a result of the execution by the trainee "T" of a training maneuver.

One example of a training maneuver which can be executed by the trainee "T" in conjunction with the use of the apparatus 100 shall now be generally described in conjunction with the accompanying figures, and in the interest of illustrating a typical use of the apparatus. The specific example which will be described pertains to training for proper throwing of a javelin. It is understood that the following description of a training maneuver is intended to provide an illustrative example of but one possible use of the apparatus of the present invention and is not intended to limit the possible uses of the apparatus in any way.

It is further understood that the training apparatus in accordance with the instant invention can be employed for other training uses, such as, by way of example only and without by way of limitation, throwing a baseball, throwing a shot put, throwing a football, or serving a tennis ball. Such alternative uses of the apparatus can necessitate, or result in, movements of the trainee's body which are different that those movements which are specifically described below for the illustrative example. It is still further understood that the description of a typical training maneuver to be used in conjunction with the apparatus 100 is not intended to provide a level of instruction sufficient to be used in an actual training regimen, or the like.

In the description of the example of the training maneuver, it shall be assumed that the trainee "T" throws with the right hand. Thus, the throwing shoulder "S" is the right shoulder of the trainee "T" as shown in the accompanying figures. Likewise, the throwing arm "A" is the right arm of the trainee "T," and the apparatus 100 is configured to releasably support the training projectile 140 substantially proximate the right shoulder of the trainee "T" as shown in the accompanying figures. Additionally, it can be assumed for the following description of a typical training maneuver, that the throwing arm "A" of the trainee "T" can be restrained in a restraint device 130 as shown for the duration of the maneuver.

The exemplary training maneuver begins with a walk or run of the trainee "T" substantially in the direction "D" of the desired direction of throw. As the location for release of the training projectile 140 is approached, the trainee "T" rotates the torso, hips, and shoulders so as to lead with the left arm, left shoulder, and left hip. The trainee takes a short skip step off the left foot and plants the right foot so as to point substantially 45 degrees to the right.

The trainee "T" then takes a driving step with the left foot, planting the left foot so as to point substantially in the direction "D" of the intended throw. The movement of the trainee "T" proceeds in the direction "D" as the weight of the trainee is transferred to the left leg and foot. The right knee and leg of the trainee "T" then begins to move in the direction "D," leading the right hip which begins to rotate forward in the direction "D." As the right hip rotates forward in the direction "D," it leads the throwing shoulder "S" which remains back to result in a twisted configuration of the torso of the trainee "T."

The trainee "T" next quickly untwists the torso so as to snap the throwing shoulder "S" forward in the direction "D." Rotation of the throwing shoulder ceases substantially at the point where the line of reference 150 is normal to the direction of throw "D." When the rotation of the throwing shoulder "S" ceases, the training projectile is released from its releasably supported position on the harness 110, whereupon the training projectile is launched in the direction "D." The training maneuver ends with the trainee "T" moving in the direction "D," but with the hips, torso, and shoulders substantially aligned with one another, and facing generally forward in the direction "D."

After the release of the training projectile 140 as the result of the execution of a training maneuver such as the one described above, the distance of travel, and the direction of travel, of the training projectile is ascertained. The efficiency and effectiveness with which the trainee "T" has executed the training maneuver can then be established by the direction and distance of travel of the training projectile.

Corrective instruction, if required, can then be provided to the trainee "T" in an attempt to facilitate achievement of greater efficiency and effectiveness in execution thereby of the training maneuver. Regular practice on the part of a trainee in executing an appropriate training maneuver, in conjunction with the use of the apparatus of the present invention, along with qualified instruction, can result in improved throwing technique.

Accordingly, a second embodiment of the present invention includes a method of training a trainee to throw, wherein the trainee has a throwing shoulder and a throwing arm, comprises providing a training projectile. The method also comprises releasably supporting the training projectile proximate the throwing shoulder of the trainee. In accordance with the method, the trainee executes a training maneuver and launches the training projectile from its supported position as a result of the execution of the training maneuver. The throwing arm can be restrained during execution of the training maneuver in order to promote proper form thereof.

When the training projectile is releasably supported proximate the throwing shoulder of the trainee, the training projectile is preferably supported proximate the outer tip of the throwing-side clavicle. A harness is preferably provided to be worn by the trainee, wherein the training projectile is releasably supported thereon. Also, if the throwing arm is restrained during execution of the training maneuver, the throwing arm is preferably restrained by a restraining device attached to the harness.

A support unit is preferably provided, wherein the support unit is mounted on the harness, and the training projectile is releasably supported on the support unit. Preferably, the position of the support unit is adjustable relative to the harness, wherein the method can comprise positioning the support unit relative to the harness such that the training projectile is releasably supported thereon substantially proximate the outer tip of the throwing-side clavicle.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An athletic training apparatus for training a trainee having a torso and a throwing shoulder, wherein a training projectile is to be launched by movement of the trainee during execution of a training maneuver, the apparatus comprising a harness configured to:

be supported substantially about the torso of the trainee;

releasably support the training projectile proximate the throwing shoulder of the trainee; and, launch the projectile there from during execution of the training maneuver.

2. The apparatus of claim 1, and further comprising a restraint device, and wherein:

the trainee has a throwing arm; and, the restraint device is configured to substantially render the throwing arm incapable of throwing an object during the training maneuver.

3. The apparatus of claim 1, and further comprising a support unit attached to the harness, wherein:

the trainee has two arm/shoulder joints;

a line of reference is defined to intersect both of the arm/shoulder joints;

the support unit is configured to releasably support the training projectile; and, the support unit is further configured to restrict movement of the training projectile to a direction which is substantially normal to the line of reference.

4. An athletic training apparatus for training a trainee having a torso and a throwing shoulder, the apparatus comprising:

a harness configured to be worn by the trainee substantially about the torso;

a support unit attached to the harness substantially proximate the throwing shoulder when the harness is worn; and, an opening defined by the support unit, the opening configured to releasably support a training projectile there within.

5. The apparatus of claim 4, and further comprising a training projectile configured to be releasably supported within the opening.

6. The apparatus of claim 5, and wherein the training projectile comprises a substantially cylindrical center portion located between two substantially rounded end portions.

7. The apparatus of claim 6, and wherein each of the end portions is substantially hemispherical.

8. The apparatus of claim 7, and wherein the training projectile has an overall length and a diameter, wherein the overall length is between about five percent and fifty percent greater than the diameter.

9. The apparatus of claim 8, and wherein:

the trainee has a throwing-side clavicle having an outer tip; and, the support unit is configured to be adjustably positioned on the harness whereby the opening substantially circumscribes the outer tip of the throwing-side clavicle.

10. The apparatus of claim 7, and wherein the training projectile has an overall length and a diameter, wherein the overall length is between about twenty percent and thirty percent greater than the diameter.

11. The apparatus of claim 4, and further comprising a restraint device attached to the harness, and wherein:

the trainee has a throwing arm; and, the restraint device is configured to substantially render the throwing arm incapable of throwing an object.

12. The apparatus of claim 4, and further comprising an adjustment device mounted on the harness and configured to facilitate adjustable positioning of the support unit relative to the harness.

13. The apparatus of claim 4, and wherein the opening passes completely through the support unit.

14. The apparatus of claim 4, and further comprising a sensor supported on the harness, wherein the sensor is configured to detect acceleration force exerted on the training projectile during execution of a training maneuver.

15. The apparatus of claim 14, and wherein the sensor is mounted withing the opening of the support unit.

16. The apparatus of claim 14, and wherein the sensor is a load cell.

17. The apparatus of claim 14, and further comprising a display unit which is connected to the sensor and which is configured to display the amount of force detected thereby.

18. An athletic training apparatus for training a trainee having a torso, a throwing shoulder, and a throwing arm, wherein the training includes launching a training projectile from the apparatus by execution of a training maneuver by the trainee, the apparatus comprising:

a harness configured to be worn substantially about the trainee's torso;

a restraint device attached to the harness and configured to substantially prevent the trainee from being able to throw with the throwing arm; and, a support unit attachable to the harness and configured to releasably support the training projectile substantially proximate the trainee's throwing shoulder.

19. The athletic training apparatus of claim 18, and wherein:

the support unit is fabricated from a substantially rigid material;

the support unit defines therein an opening; and, the opening is configured to releasably support the training projectile there within.

20. The athletic training apparatus of claim 19, and wherein:

the trainee's throwing shoulder includes a throwing-side clavicle tip;

the support unit is positionable relative to the throwing-side clavicle tip;

the opening is in the form of an annular passage that passes completely through the support unit in facilitation of the positioning thereof, wherein the throwing-side clavicle tip is substantially circumscribed by the opening.

21. The athletic training apparatus of claim 19, and wherein:

the trainee has a pair of arm/shoulder joints;

a line of reference is defined to intersect the pair of arm/shoulder joints;

an interior wall defines at least a portion of the opening; and, the interior wall is configured to facilitate launching of the training projectile in a direction substantially normal to the line of reference.

22. The athletic training apparatus of claim 21, and wherein:

the opening is substantially in the form of a cylinder; and, the interior wall forms at least a portion of the cylinder.

* * * * *